US005469344A

United States Patent [19]

Kotsakis

[11] Patent Number: 5,469,344

[45] Date of Patent: Nov. 21, 1995

[54] SUPPORT FOR DECORATIVE LIGHT STRING ON A BUILDING

[76] Inventor: Ted Kotsakis, 1702 Duke Ct., Eugene, Oreg. 97401

[21] Appl. No.: 123,055

[22] Filed: Sep. 20, 1993

[51] Int. Cl.[6] ..... F21V 21/00

[52] U.S. Cl. ..... 362/145; 362/249; 362/382; 362/806

[58] Field of Search ..... 362/806, 249, 362/145, 391, 252, 382

[56] References Cited

U.S. PATENT DOCUMENTS

| | | | |
|---|---|---|---|
| 2,052,425 | 12/1933 | Simeone | 240/10 |
| 3,540,687 | 11/1970 | Cuva | 362/249 |
| 3,692,993 | 9/1972 | Robinson | 362/249 |
| 4,128,863 | 12/1978 | Premetz | 362/806 |
| 4,357,653 | 11/1982 | Kovacs | 362/388 |
| 4,704,669 | 11/1987 | Brunner | 362/800 |
| 4,769,749 | 9/1988 | Felski | 362/250 |
| 4,888,671 | 12/1989 | Reimer | 362/250 |
| 4,935,852 | 6/1990 | Hsu | 362/382 |
| 4,995,181 | 2/1991 | Wolf | 40/152 |

*Primary Examiner*—Ira S. Lazarus
*Assistant Examiner*—Sara Sachie Raab
*Attorney, Agent, or Firm*—James D. Givnan, Jr.

[57] ABSTRACT

An elongate member is disclosed defining spaced apart openings each for inserted reception of a decorative light bulb of a light string. Flanges provided on the interior of each of the openings frictionally engage the light bulb surface and restrain same against accidental separation from the opening. Apertures in the elongate member each serve to receive a fastener, such as a finishing nail, attaching the elongate member to a wall surface. The elongate members are of a convenient length to permit orderly bundling of those elongate members associated with a single light string to provide for orderly removal, storage and installation of the light string.

7 Claims, 1 Drawing Sheet

SUPPORT FOR DECORATIVE LIGHT STRING ON A BUILDING

BACKGROUND OF THE INVENTION

The present invention pertains generally to decorative lighting such as strings of Christmas tree lights and more particularly to a support therefor.

A common practice for the attachment of lights to a home or other building is by the suspension of the conductor for the lights on nails or hooks driven into the siding material of the house or other type of building. The light string is placed on the nails, hooks, etc., by resting same thereon at spaced apart intervals. A drawback to such installation of a light string is the reluctance of many homeowners to drive nails at close intervals into a wall surface. A further drawback is that lights so attached are subject to being dislodged by gusts of wind.

A further problem encountered by homeowners in the use of decorative lights is that such strings can readily tangle during installation, storage or removal of the strings. The somewhat fragile nature of decorative lighting renders same susceptible to damage during the time consuming task of untangling.

U.S. Pat. No. 4,995,181 is of interest in that it discloses a tubular light support with opposed edges defining openings at intervals for the reception of the light bulbs of a string of decorative lights. Corner pieces join multiple light supports to form a light supporting frame. The conductor and the light sockets thereon are housed in the tubular support.

U.S. Pat. No. 4,888,671 discloses a flexible light holding strip for wall attachment. Separate light holders are slidably mounted on the strip and each defines a light receiving socket.

U.S. Pat. No. 4,769,749 shows a pliable plastic strip to which a string of Christmas lights may be attached with the light socket in frictional engagement with the strip.

U.S. Pat. No. 4,357,653 shows a light holding frame with corner pieces and with sockets formed along the frame members. A conductor passes along a channel formed in each frame member. Bulb sockets on the light string slide laterally into place in slotted bores.

U.S. Pat. No. 2,052,425 shows hingedly attached light supports each having a series of pairs of flanges between which paired flanges are inserted the socket of each light bulb of a light string.

SUMMARY OF THE PRESENT INVENTION

The present invention is embodied within a support for a segment of a decorative light string such as those commonly known as Christmas lights.

A support member is provided to which a number of decorative lights may be attached by the insertion of the light string bulbs through sockets or openings at intervals along the support. Provision is made in the support for the reception of wall engageable retainers which permit attachment as well as removal from a wall structure in a convenient manner. Frictional engagement of the light bulbs of the string with the support is enhanced by the use of multiple flanges disposed about the inner periphery of each light receiving opening of the present support. Accordingly, the light string is firmly attached to the support in all instances until intentional effort is made to disengage the bulbs from the support. In the matter of storing a light string, storage is greatly facilitated by the user utilizing the conductor of the light string as a means for pivotally inter-connecting the supports in a bundled or stacked manner. Such removal and storage of a light string in this manner precludes tangling of the string with itself or other strings of lights.

Important objectives of the present invention include the provision of an elongate support for use in conjunction with additional like supports for installing a string of decorative lights on a home or other structure; the provision of an elongate support for a segment of a light string with the lights thereof being in frictional engagement with the support to prevent accidental separation during use as well as storage; the provision of a support for a segment of a decorative light string which greatly reduces the number of retainers inserted into the exterior wall of the house or other building; the provision of a support for a segment of a light string which support is adapted for positioning on a pair of retainers in place on a house or building wall; the provision of multiple supports for a string of decorative lights which in addition to maintaining the lights in place during display also serves to assure orderly storage of the lights without tangling.

DETAILED DESCRIPTION OF THE PREFERRED EMBODIMENT

Figure 1:
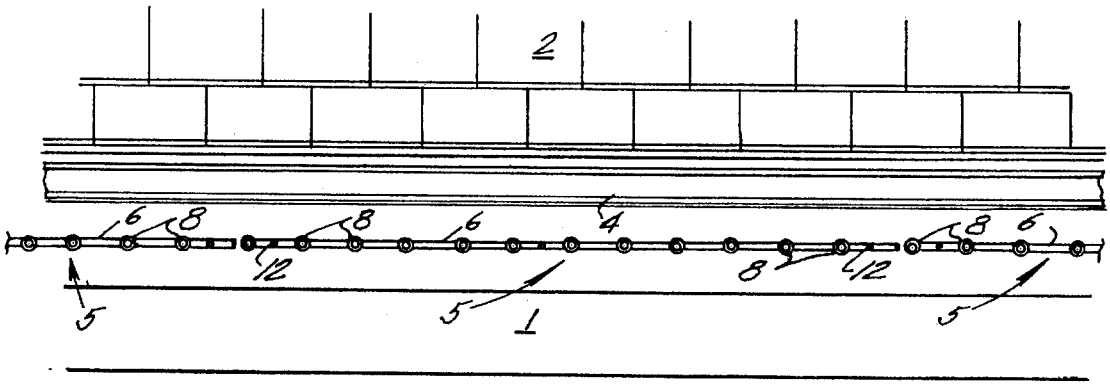
FIG. 1 is a fragmentary elevational view of the side of a house with the present light support in place.
Figure 1:
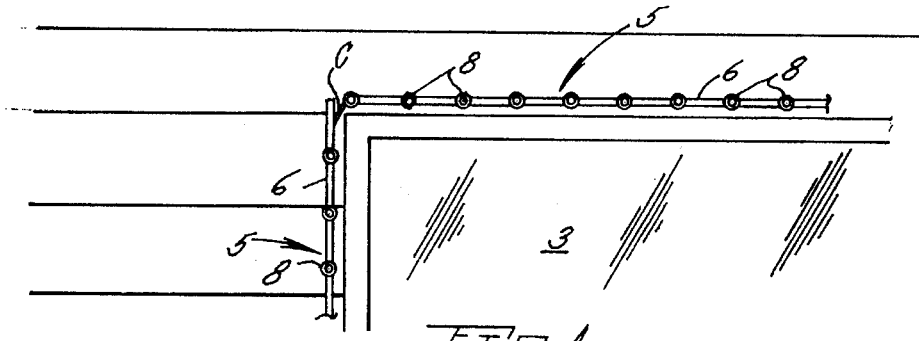
Figure 2:
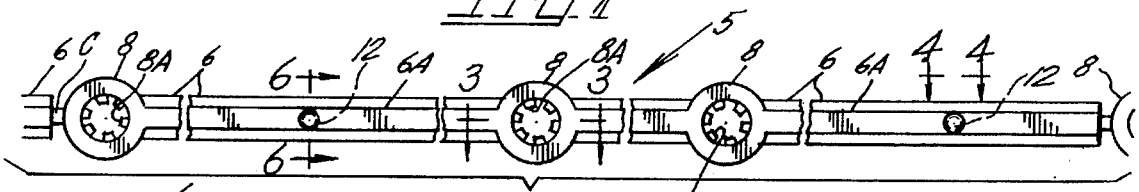
FIG. 2 is a front elevational view of the present light support sectioned for purposes of illustration.

With continuing attention to the drawings, wherein applied reference numerals indicate parts similarly hereinafter identified, the reference numeral 1 indicates side of a building structure such as a home having windows as at 3. A roof is at 2 while a gutter is at 4.

Indicated generally at 5 is the present light support shown in use in FIG. 1 in conjunction with additional light supports 5 for a decorative string of Christmas lights or the like.

The light support includes an elongate member 6 having sockets spaced therealong for the reception of bulbs 10 of the light string. The present light support receives the lights 10 one each in a socket or receptacle at 8 provided with projecting flanges 8A arranged in a series about the socket inner periphery 8B. The flanges 8A have innermost edges which are frictionally engaged by the light bulb 10 and seat on the tapered part of the bulb with the flanges serving to retain the bulb against all but intentional extraction. The innermost edges of the flanges 8A may be beveled to enhance frictional engagement with the inserted light bulb.

With attention again to elongate member 6, ribs 6A and 6B, along the length of the member, reinforce same against lateral deflection and permit the unit to be of minimum weight.

The elongate member additionally defines laterally extending apertures 11 of a diameter to receive a retainer such as finishing nail 12 embedded in wall siding 1.

Figure 5:
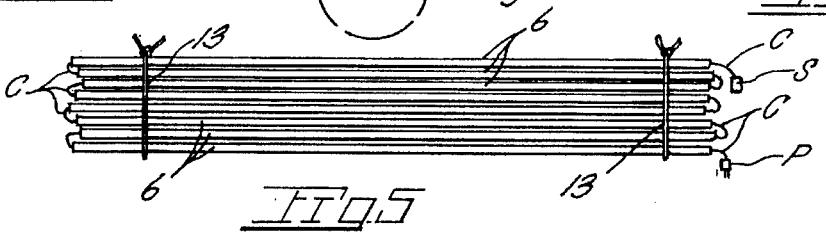
FIG. 5 is a side elevational view of a collection of the present light supports associated with a string of decorative lights bundled for storage.

In FIG. 5 a light string with a conductor C is shown installed on a number of light supports with the elongate member 6 of the supports stacked or bundled with ties at 13. A plug P and a socket S are disposed for coupling to like components of adjacent light strings attached in place on a building by consecutive light supports 5.

Figure 6:
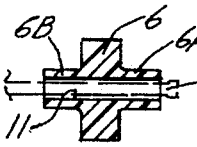
FIG. 6 is a vertical sectional view taken along line 6—6 of FIG. 2.
Figure 3:
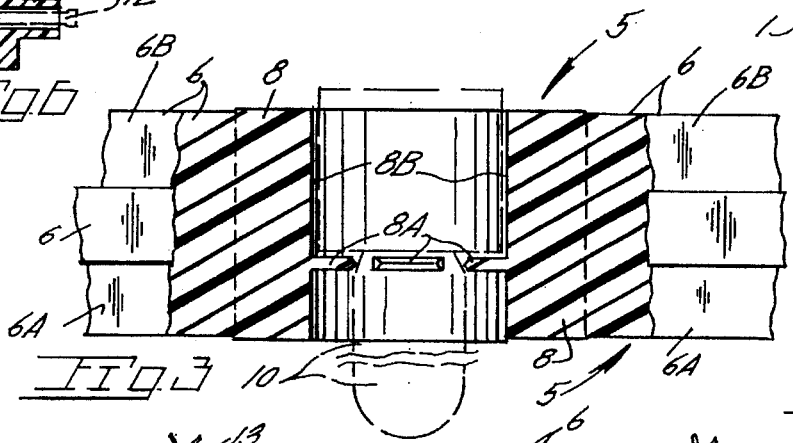
FIG. 3 is a horizontal sectional view taken downwardly along line 3—3 of FIG. 2.
Figure 4:
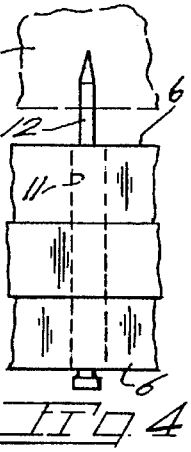
FIG. 4 is a horizontal plan view taken along line 4—4 of FIG. 2.

The elongate members are as shown in FIG. 6, preferably of cruciform section to provide adequate strength while minimizing weight and the amount of synthetic resinous material used in forming each member.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A support for several light bulbs of a segment of a string of decorative light bulbs spaced along a conductor for decorating a building structure, said support comprising, a rigid elongate member defining multiple openings extending therethrough and spaced therealong, each of said openings adapted for the inserted reception of one of said light bulbs of said several light bulbs, friction means on said member at least partially defining each of said multiple openings for frictional engagement with one of the light bulbs when inserted therein, and additional openings extending through said elongate member each for the reception of a retainer.

2. The support claimed in claim 1 wherein said friction means are flanges projecting inwardly into said openings.

3. The support claimed in claim 2 wherein said flanges are of a yieldable nature.

4. The support claimed in claim 3 wherein said flanges terminate in beveled edges.

5. The support claimed in claim 1 wherein said elongate member is of cruciform section.

6. The support claimed in claim 1 wherein said elongate member includes ribs extending lengthwise of the member.

7. The support claimed in claim 1 wherein said elongate member is of synthetic resinous material.

* * * * *